US006082004A

United States Patent [19]

Hotani

[11] Patent Number: 6,082,004

[45] Date of Patent: Jul. 4, 2000

[54] RECIPROCATING TYPE ELECTRIC SHAVER

[75] Inventor: Yoshiaki Hotani, Tsuna-gun, Japan

[73] Assignee: Sanyo Electric Co., Ltd., Osaka, Japan

[21] Appl. No.: 09/174,557

[22] Filed: Oct. 19, 1998

[30] Foreign Application Priority Data

Oct. 20, 1997 [JP] Japan ..... 9-286808

[51] Int. Cl.[7] ..... B26B 19/10

[52] U.S. Cl. ..... 30/43.92; 30/346.51

[58] Field of Search ..... 30/43, 43.92, 346.51

[56] References Cited

U.S. PATENT DOCUMENTS

| | | | |
|---|---|---|---|
| 2,245,795 | 6/1941 | Landgraf | 30/346.51 |
| 2,416,094 | 2/1947 | Gray | 30/43.92 |
| 2,539,011 | 1/1951 | Denocenzo | 30/346.51 |
| 2,787,829 | 4/1957 | Bayne | 30/43.92 |
| 5,669,138 | 9/1997 | Wetzel | 30/43.92 |
| 5,893,211 | 4/1999 | Hotani | 30/43.92 |

FOREIGN PATENT DOCUMENTS

| | | | |
|---|---|---|---|
| 0077093 | 4/1983 | European Pat. Off. | 30/43.92 |
| 980755 | 5/1951 | France | 30/43.92 |
| 11 14 117 | 9/1961 | Germany . | |
| 15 53 713 | 10/1970 | Germany . | |
| 20 19 978 | 11/1971 | Germany . | |

*Primary Examiner*—Hwei-Siu Payer
*Attorney, Agent, or Firm*—Wenderoth, Lind & Ponack, L.L.P.

[57] ABSTRACT

A reciprocating type electric shaver has close shaving blades and rough shaving blades provided in a head section. Each rough shaving blade has a stationary upper blade with a topside and a single side-wall bent into an inverted L-shaped cross-section, and a movable lower blade which slides along an inside surface of the stationary upper blade. Curled beard slits and a stationary trimmer blade are provided on opposite sides of the topside. The curled beard slits span from a center region of the topside to the side-wall, and the stationary trimmer blade extends from the center region of the topside to an outer edge of the topside.

10 Claims, 4 Drawing Sheets

PRIOR ART

PRIOR ART

RECIPROCATING TYPE ELECTRIC SHAVER

This application is based on application No.9-286808 filed on Oct. 20, 1997 in Japan, the content of which is incorporated hereinto by reference.

BACKGROUND OF THE INVENTION

This invention relates to an electric shaver. Various electric shaver configurations have been proposed to shave as quickly as possible or to reduce unshaved remaining whiskers. There are many different types of beards, including stiff, soft, long, short, straight and curly. Further, there are difficult to shave regions such as under the nose on the cheek and on the chin line.

Rotary type shavers and reciprocating type shavers are used, for example, depending on skin and beard conditions. Further, these different types of electric shavers are provided with trimmer blades for cutting hair such as sideburns, and with outer blade slits for pulling in and cutting curled whiskers.

A reciprocating type electric shaver with multiple heads combining arch-shaped finishing blades and short roughing blades provided with slits is well known. Turning to FIG. 1, this type of reciprocating electric shaver is shown. This reciprocating type electric shaver has a body 1, and a head section 2 provided at the upper end of the body 1. Driving parts such as a battery, motor, and vibrator which converts motor rotation to reciprocating motion, are provided within the body 1. In addition, a power switch 3 which can slide up and down is provided on one surface of the body 1, while a retractable trimmer 4 is provided on the opposite surface.

The head section 2 is provided with four rows of shaving blade heads. In the center, it has two rows of arch-shaped blade heads 5, and on either side, it has rectangular blade heads 6. The arch-shaped blade heads 5 have small holes in their outer blades and are used primarily for finishing or finer shaving. The rectangular blade heads 6 have slits in their outer blades and are used for rough cutting of a curled beard.

Turning to FIG. 2, an enlarged view of a rectangular blade head 6 is shown. A outer blade 62 of the rectangular blade head 6 is formed with a cross-sectional shape of an inverted-U which surrounds an inner blade 61. Slits 63 are formed in the outer blade 62 which span from the top surface to the side walls. Short curled whiskers can be guided into the slits 63 through the top surface or the side walls of the outer blade 62. Therefore, a rectangular blade head 6 can cut a curled beard short.

After curled whiskers are cut short, closer shaving is performed by the previously mentioned arch-shaped blade heads 5 provided adjacent and parallel to the rectangular blade heads 6. Because rough cutting and fine cutting are performed continuously in this manner, a beard can be shaved efficiently and conveniently. Further, since each rectangular blade head 6 is made in a long narrow shape which follows along the shape of the arch-shaped blade head 5, the head section 2 can be made compact.

However, the previously mentioned rectangular blade heads 6 cannot sufficiently cut hair such as long curled beards or sideburns. The slits 63 provided in the outer blade 62 of the rectangular blade head 6 are formed over an extremely narrow region and the length of each slit 63 is also quite short. Therefore, curled whiskers longer than the slit length or large curly whiskers cannot be adeptly guided into the blade head.

This type of hair, such as long curled beards and sideburns, can be cut using the previously described trimmer 4. However, the trimmer 4 is provided in the body 1 of the shaver and cannot be used continuously with the blade heads disposed in the head section 2. Each time the trimmer 4 is used, an operation to open and close the trimmer 4 is required. Further, the trimmer requires trimmer parts on the shaver body 1, as well as internal parts such as those to transmit driving motion from the vibrator to the trimmer. This results in a large number of parts and a complex structure. In addition, the shaver body must be enlarged to fit these extra parts.

Thus, it is an object of this invention to provide a reciprocating type electric shaver wherein the trimmer blades and the beard shaving blades can be used conveniently without interrupting continuous shaving, and the trimmer structure is simplified to reduce the number of parts in the shaver body and to reduce the size of the shaver.

The above and further objects and features of the invention will more fully be apparent from the following detailed description and accompanying drawings.

SUMMARY OF THE INVENTION

A reciprocating type electric shaver comprising a body and a head section, blades for close shaving and blades for rough shaving are provided in parallel rows. The blades for rough shaving are provided with a stationary upper blade comprising a topside and a single side-wall bent into the cross-sectional shape of an inverted-L, and a movable lower blade which rubs against the inside surface of the stationary upper blade. The upper stationary blade is characterized in that two elongated blade areas are formed in the topside. In one elongated blade area, curled beard slits are formed spanning from the center of the topside to the side-wall. In the other elongated blade area, trimmer blades are formed extending from the center of the topside to the edge of the stationary upper blade.

According to the present invention, blades for close shaving and blades for rough shaving are provided in parallel rows in the head section of the reciprocating type electric shaver, and two types of elongated blade areas are formed in the blade for rough shaving. The two types of elongated blade areas are one for curled beards and one for trimming. Therefore, rough shaving and close shaving all the way to curled beard and sideburn cutting can be performed by the head section. Moreover, since all this is performed by the head section alone, continuous, efficient shaving can be performed in a short time period.

Further, unlike the related art case where the trimmer is disposed in the shaver body, there is no requirement to re-grip the shaver of this invention to put the shaver body trimmer against the surface of the face. The trimmer cuts easily putting only the head section against the face. Still further, since there is no need to install a trimmer in the shaver body, the structure of the body can be simplified. This makes the shaver smaller, lighter in weight, and improves the assembly process. Finally, since the locations of both the blades for close shaving and the blades for rough shaving are concentrated in the head section, the driving structure can be concentrated in the head section and power transmission loss from the motor to the blades can be reduced.

DETAILED DESCRIPTION OF THE INVENTION

Figure 3:
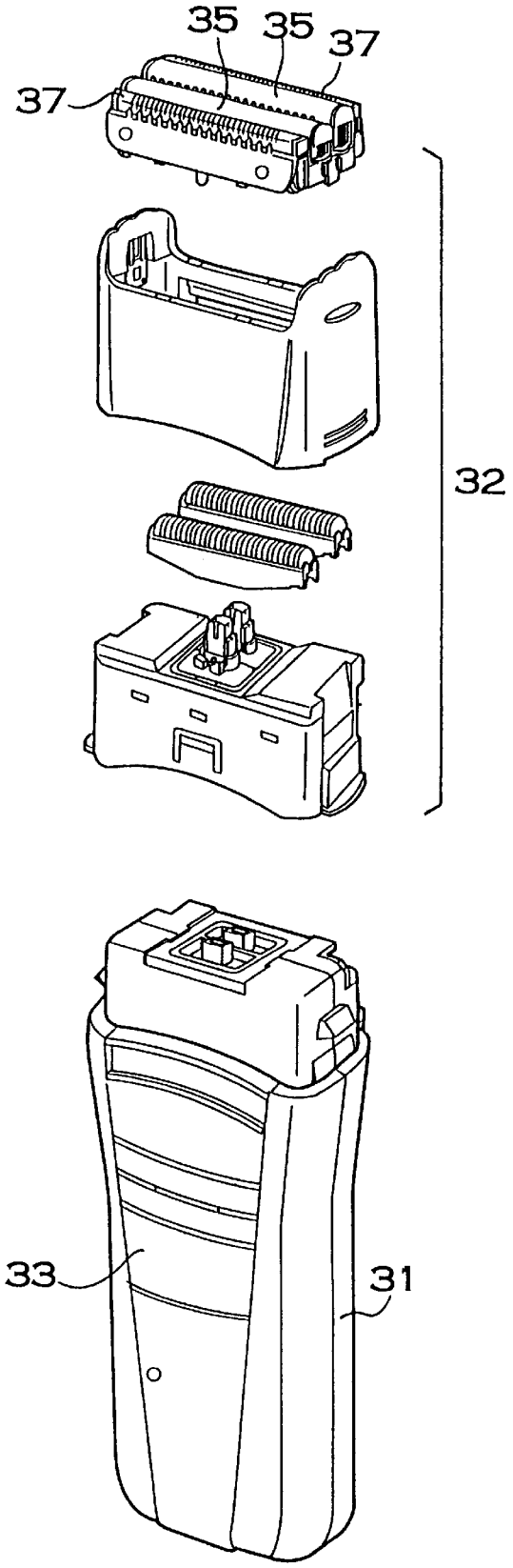
FIG. 3 is an overall external view of a reciprocating type electric shaver of the present invention.

An embodiment of the present invention is explained with reference to the drawings. FIG. 3 shows a reciprocating type electric shaver of the present invention. This reciprocating type electric shaver is configured with a shaver body 31, a head section 32 and a power switch similar to the related art reciprocating type electric shaver shown in FIG. 1. However, the shaver body 1 shown in FIG. 3 does not have a trimmer.

Therefore, structural elements related to the trimmer can be omitted. Namely, elements can be omitted such as a retractable trimmer base, the switch mechanism for opening and closing the trimmer, and levers, etc., connected to the vibrator to transmit reciprocating motion to the movable blade. Consequently, the shaver body 31 can by made smaller and lighter by elimination of those internal parts and externally exposed parts related to the trimmer. This parts reduction also improves the ease of assembly.

Figure 1:
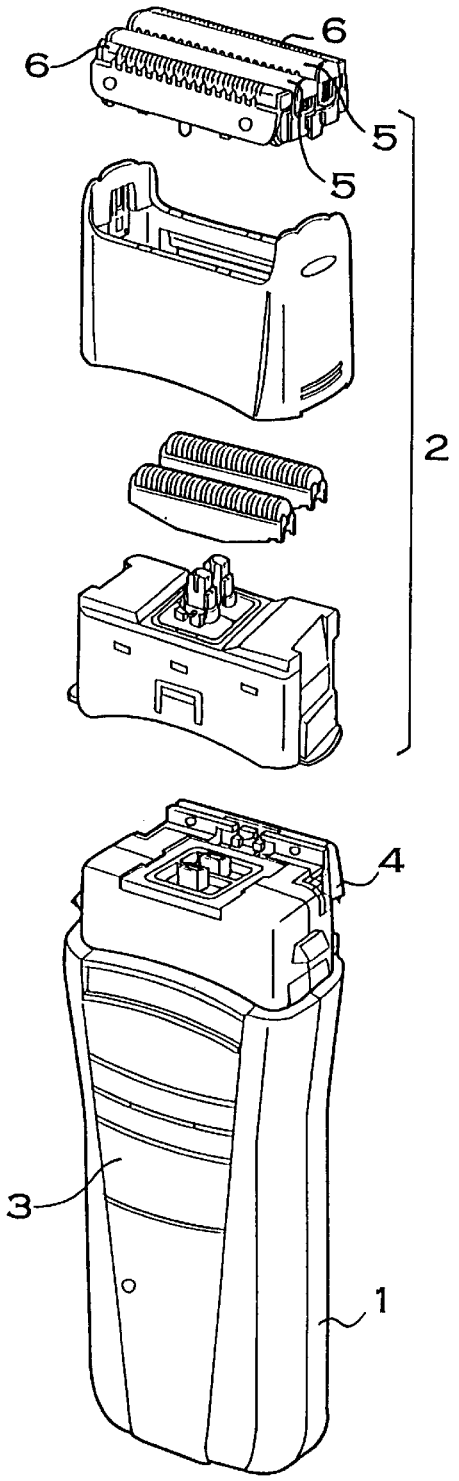
FIG. 1 is an overall external view of a related art reciprocating type electric shaver.
Figure 2:
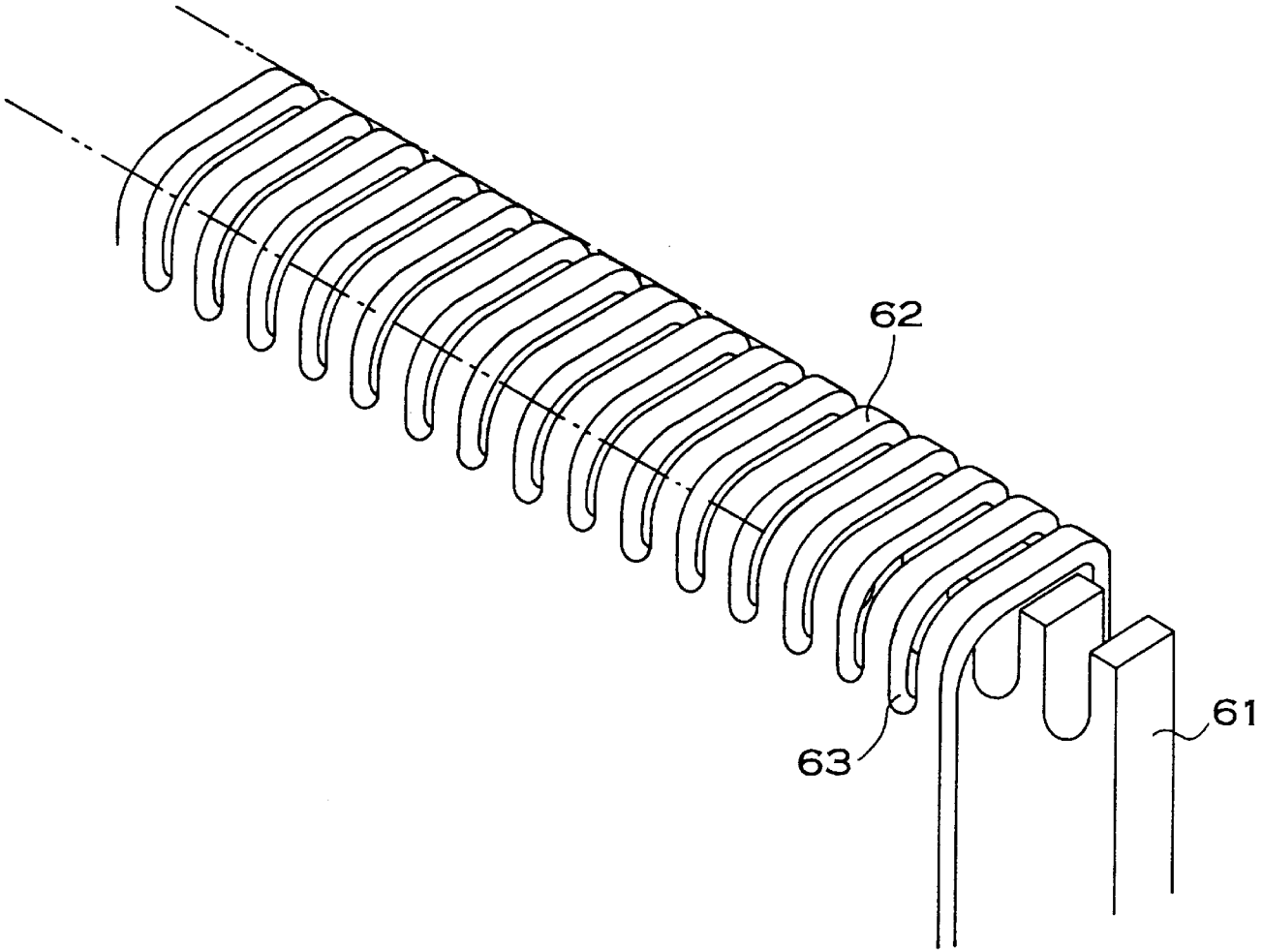
FIG. 2 is an oblique view of a related art rectangular blade for rough shaving.

The head section 32 is provided with four rows of blade heads with two rows of arch-shaped blade heads 35 disposed in the center similar to the head section 2 shown in FIG. 1. However, the shaver head section 32 shown in FIG. 3 has blade heads 37 with inverted L-shaped cross-sections on both sides of the arch-shaped blade heads 35. The arch-shaped blade heads 35 are used as close shaving or finishing blades, and the blade heads 37 with inverted L-shaped cross-sections are used as rough cutting blades.

Figure 4:
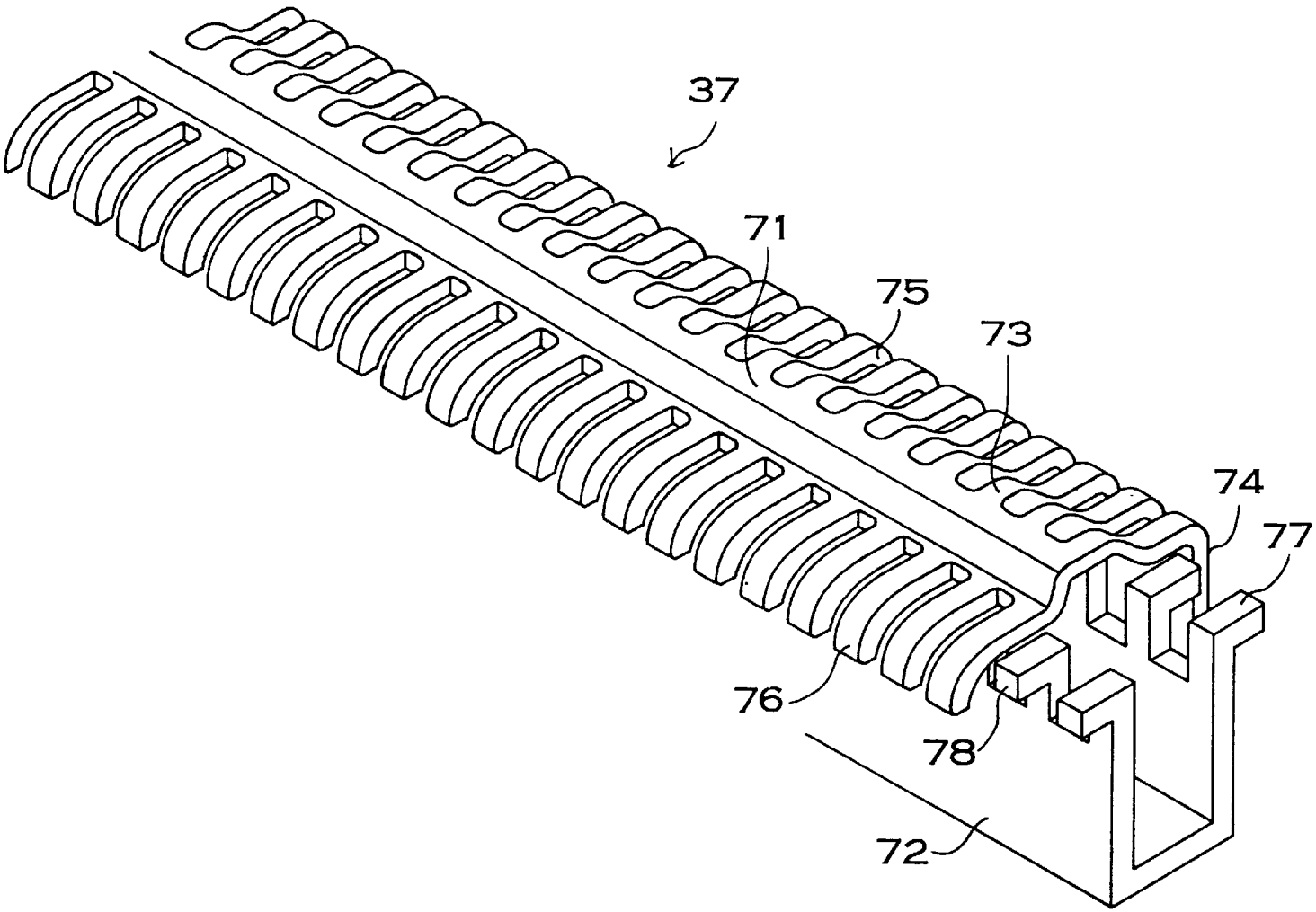
FIG. 4 is an oblique view of an L-shaped blade for rough shaving of the present invention.

FIG. 4 shows an enlarged view of a blade head 37 with an inverted L-shaped cross-section. The blade head 37 is configured with a stationary upper blade 71 and a movable lower blade 72. The stationary upper blade 71 is formed from a topside 73 and a single side-wall 74 bent into the cross-sectional shape of an inverted-L. Two elongated blade areas are formed in the topside 73. In one elongated blade area, curled beard slits 75 span from the center of the topside 73 to the side-wall 74. In the other elongated blade area, a stationary trimmer blade 76 extends from the center of the topside 73 to the edge of the stationary upper blade. Further, the other elongated blade area the other elongated blade area where the stationary trimmer blade is provided on the topside of the stationary upper blade shown in the figure, is curved downward at its outer-most edge. The center region of the topside 73 protrudes upward. The curled beard slits 75 extend from the protrusion at the center of the topside 73 to the side-wall 74.

The movable lower blade 72 has a channel-shape to fit within the space inside the stationary upper blade 71. A lower curled beard blade 77 and a movable trimmer blade 78 are provided within the inside surfaces of the curled beard slits 75 and the stationary trimmer blade 76 respectively. The lower curled beard blade 77 and movable trimmer blade 78 move back and forth sliding against the inside surfaces of the curled beard slits 75 and the stationary trimmer blade 76. The upper ends of the channel-shaped movable lower blade shown in the figure are bent outward, and the lower curled beard blade and movable trimmer blade are provided on the upper surfaces of those bent regions. Further, in the movable lower blade shown in the figure, the lower curled beard blade and movable trimmer blade rub against the inside surfaces of the stationary upper blade on both sides of the protrusion provided at the center of the topside.

The curled beard slits 75 and the lower curled beard blade 77 allow short difficult-to-shave whiskers and somewhat curled whiskers through the slits 75 for cutting. On the other hand, the stationary trimmer blade 76 and the movable trimmer blade 78 can easily cut long curled whiskers and areas such as the sideburns because they are formed with their blade ends projecting outward. Finally, the protruding region at the center of the topside 73 gives the slits 75 an angle which serves the purpose of straightening up curled whiskers and making it easier to induce curled whiskers into the slits 75. The protruding region also reinforces the entire stationary upper blade 71 and prevents it from distorting due to excessive pressure against the skin.

As described above, this reciprocating type electric shaver is provided with four rows of blades in its head section. Close finishing shaving can be performed by arch-shaped blades at the center of the head section, and rough shaving can be performed by L-shaped blades on either side. An L-shaped blade has two types of blade areas, the trimmer blade and the blade with slits for cutting curled beards. The L-shaped blade can cut various types of beards and sideburns. As a result, the head section 32 can shave various types of beards without interruption all the way from rough cutting to close shaving, and it can shave extremely efficiently and quickly.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims or equivalence of such metes and bounds thereof are therefore intended to be embraced by the claims.

What is claimed is:

1. A reciprocating type electric shaver, comprising:

a head section;

at least one close shaving blade for finishing provided in said head section;

at least one rough shaving blade provided in said head section parallel to said at least one close shaving blade, said at least one rough shaving blade comprising:

a stationary upper blade formed with an inverted L-shaped cross-section and having a topside and a single side-wall, said stationary upper blade being provided with curled beard slits and a stationary trimmer blade on opposite sides of said topside;

said curled beard slits spanning from an upwardly protruded region of said topside to said single side-wall, and said stationary trimmer blade extending towards an outer-most edge of said topside; and a moveable lower blade which slides along an inside surface of said stationary upper blade.

2. The reciprocating type electric shaver as recited in claim 1, wherein said at least one close shaving blade comprises an arch-shaped head.

3. The reciprocating type electric shaver as recited in claim 1, wherein said at least one rough shaving blade comprises a pair of rough shaving blades provide on opposing sides of said at least one close shaving blade.

4. The reciprocating type electric shaver as recited in claim 1, wherein:

said at least one rough shaving blade comprises a pair of rough shaving blades; and said at least one close shaving blade comprises a pair of close shaving blades.

5. The reciprocating type electric shaver as recited in claim 1, wherein said upwardly protruded region is formed at a center region of said topside.

6. The reciprocating type electric shaver as recited in claim 5, wherein said curled beard slits span from said upwardly protruded region at the center region of said topside to said single side-wall.

7. The reciprocating type electric shaver as recited in claim 1, wherein the outer-most edge of said topside curves downward.

8. The reciprocating type electric shaver as recited in claim 1, wherein said moveable lower blade is channel-shaped and is provided with a lower curled beard blade and a moveable trimmer blade, said lower curled beard blade located adjacent to said curled beard slits and said moveable trimmer blade located adjacent to said stationary trimmer blade.

9. The reciprocating type electric shaver as recited in claim 8, wherein said lower curled beard blade and said moveable trimmer blade each slide along the inside surface of said stationary upper blade on opposite sides said upwardly protruded region of of said topside.

10. The reciprocating type electric shaver as recited in claim 8, wherein said moveable lower blade has upper ends which are bent outward, forming said lower curled beard blade and said moveable trimmer blade.

* * * * *